US005286940A

United States Patent [19]

Leeds

[11] Patent Number: 5,286,940

[45] Date of Patent: Feb. 15, 1994

[54] MICROWAVE OVEN BREAK AWAY ELEMENT TRIM KIT

[76] Inventor: Harlan S. Leeds, 7004 Creekbent, Dallas, Tex. 75252

[21] Appl. No.: 936,289

[22] Filed: Aug. 28, 1992

[51] Int. Cl.[5] ..... H05B 6/80

[52] U.S. Cl. ..... 219/762; 219/739; 126/273 A

[58] Field of Search ..... 219/10.55 R, 10.55 E; 126/273 A, 273 R; 312/236, 242

[56] References Cited

U.S. PATENT DOCUMENTS 4,332,993 6/1982 Shibahara et al. ..... 219/10.55 R
4,481,395 11/1984 Smith et al. ..... 219/10.55 E
4,935,593 6/1990 Nishikawa ..... 219/10.55 R
5,017,750 5/1991 Igarashi ..... 219/10.55 R

*Primary Examiner*—Philip H. Leung
*Attorney, Agent, or Firm*—Warren H. Kintzinger

[57] ABSTRACT

A trim kit for a microwave oven inserted in a rectangular wall opening is provided with opposite side upright trim elements and upper and lower trim air vent elements surrounding the front face of the microwave oven. Both upper and lower trim air vent elements have notched break away strips both horizontally and vertically to provide front trim facing above and below a microwave oven mounted in a wall opening. The opposite side upright trim elements also have notched break away strips both horizontally and vertically to enable proper fit in the trim element facing assembly around the front of a microwave oven.

8 Claims, 5 Drawing Sheets

MICROWAVE OVEN BREAK AWAY ELEMENT TRIM KIT

Figure 1:
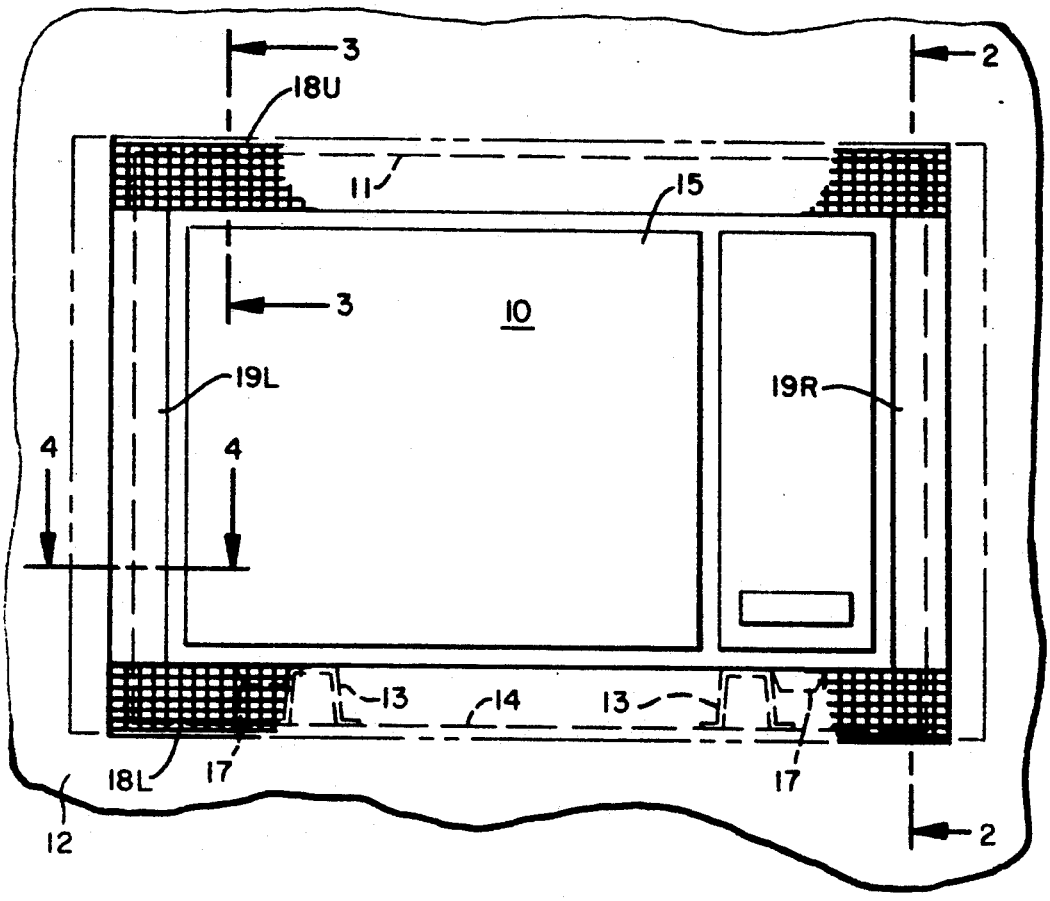

This invention relates in general to microwave oven and other in the wall opening mounting appliances, and in particular, to an in the wall mounted microwave oven break away element trim kit.

Various approaches have been taken with respect to the mounting of appliances in an in the wall opening installation particularly with respect to front facing trim around the front face of the appliance. Many trim elements used heretofore to cover hole space around an appliance a microwave oven, for example, are oversize and awkward to handle and difficult to install in place. Trim kits for such use should have facing elements readily adjustable in both length and width with break away strips to adjust to the proper trim size for facing around an in the wall mounted appliance.

It is therefore a principal object of this invention to provide facing trim elements easily adjusted both length and width wise for balanced proper installation around the front of an in the hole wall mounted appliance.

Another object with these facing trim elements is for them to be preconditioned for easy break away of incremental strips in adjustment to proper size for facing installation.

A further object of such a facing trim kit for in the wall hole mounted microwave ovens is to supply one facing element trim kit readily adjustable to an extensive range of microwave oven sizes and various size openings they are mounted in.

Still another object is to provide such a facing trim kit with air circulation openings provided in both top and bottom facing trim kit elements.

Features of the invention useful in accomplishing the above objects include, in a microwave oven break away element trim kit, opposite side upright trim elements and upper and lower trim air vent elements surrounding the front face of the microwave oven. Both upper and lower trim air vent elements have notched break away strips both horizontally and vertically to provide front trim facing with multiple openings along each of a plurality of horizontally break away strips above and below a microwave oven mounted in a wall opening. The opposite side upright trim elements also have notched break away strips both horizontally and vertically to enable proper fit in the trim element facing assembly around the front of a microwave oven.

A specific embodiment representing what is presently regarded as the best mode of carrying out the invention is illustrated in the accompanying drawings.

In the drawings

Figure 2:
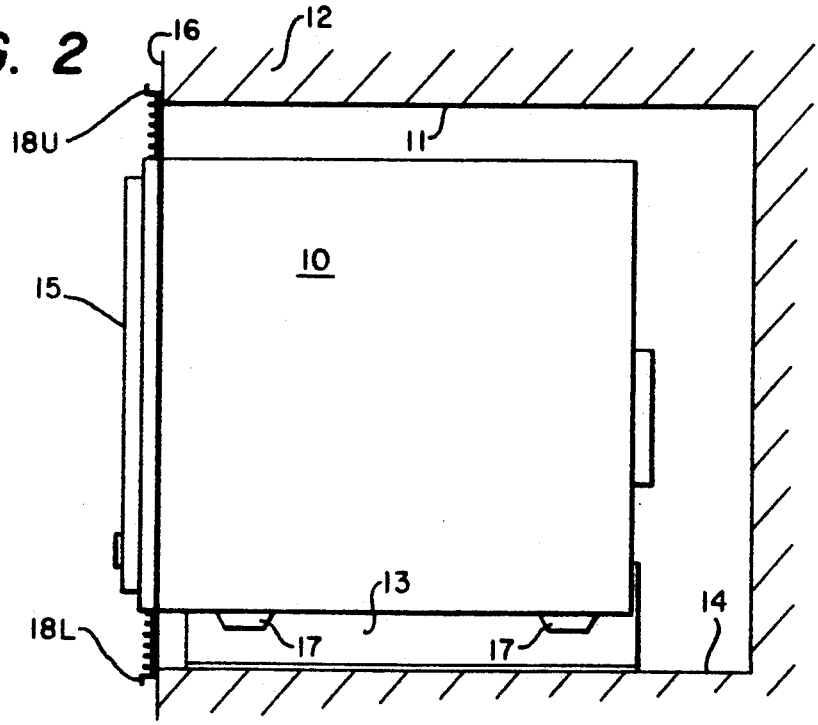
Figure 3:
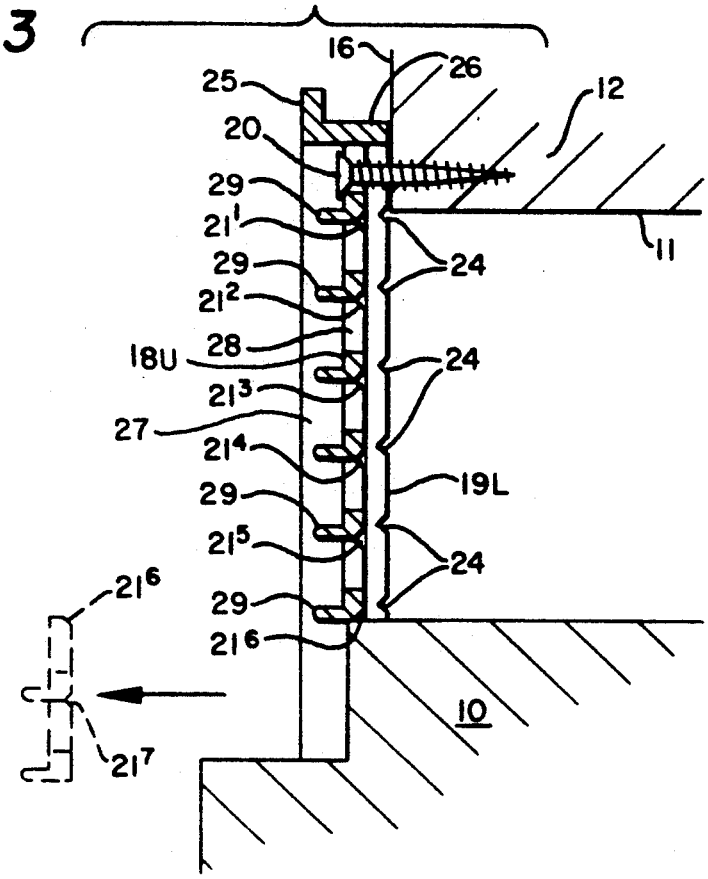
Figure 4:
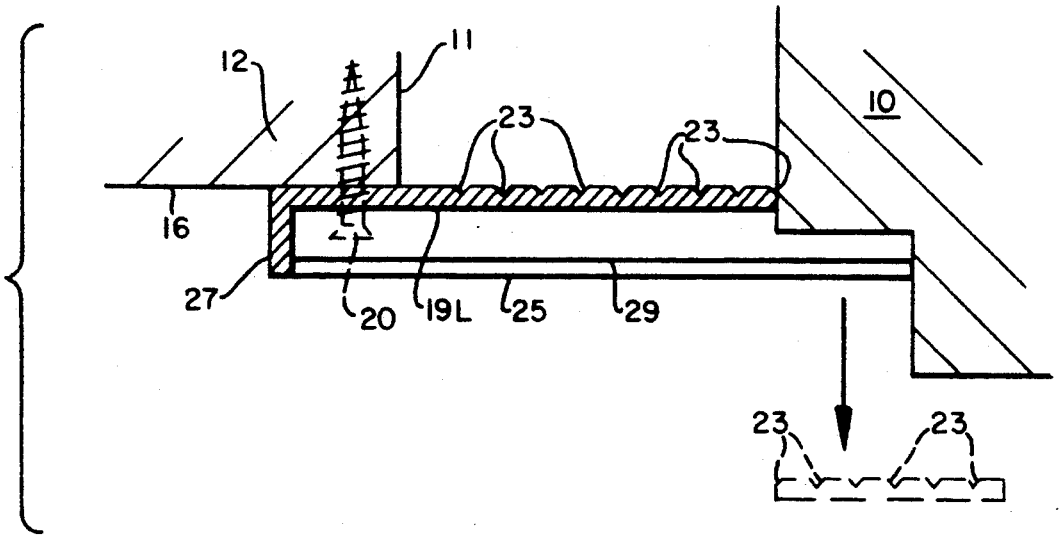
Figure 5:
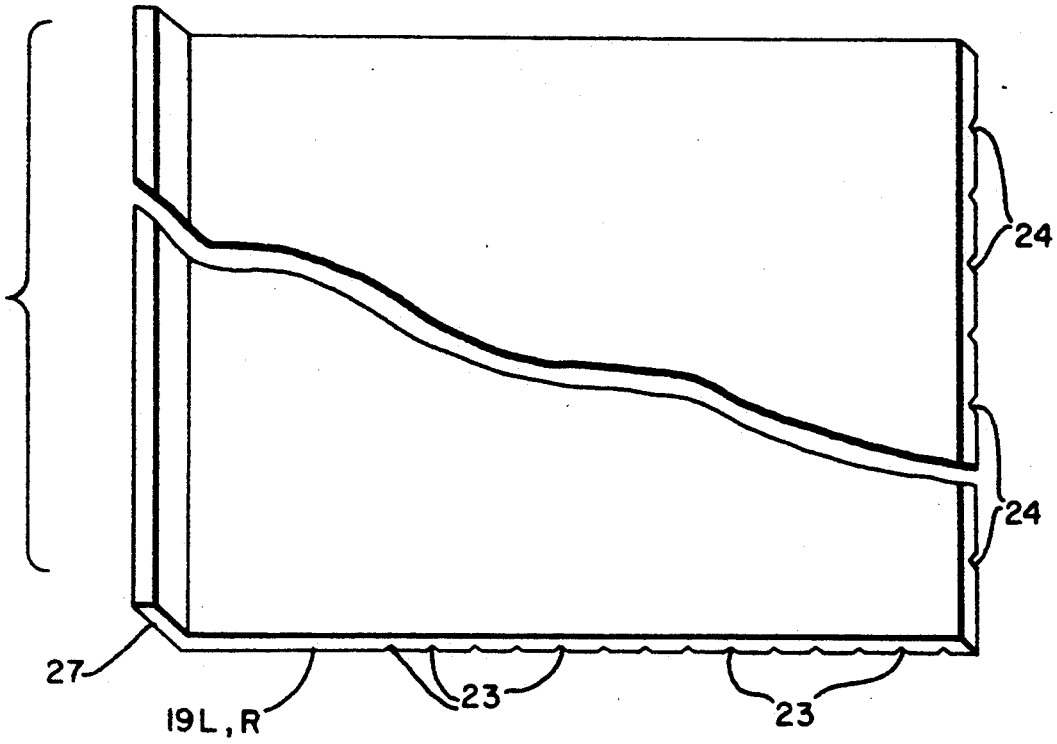
Figure 6:
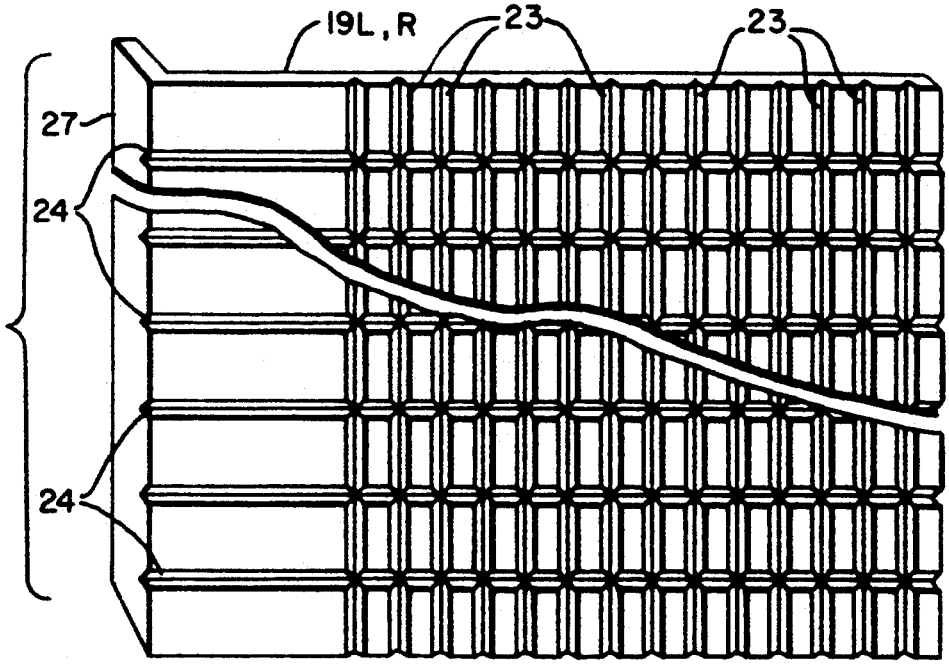
Figure 7:
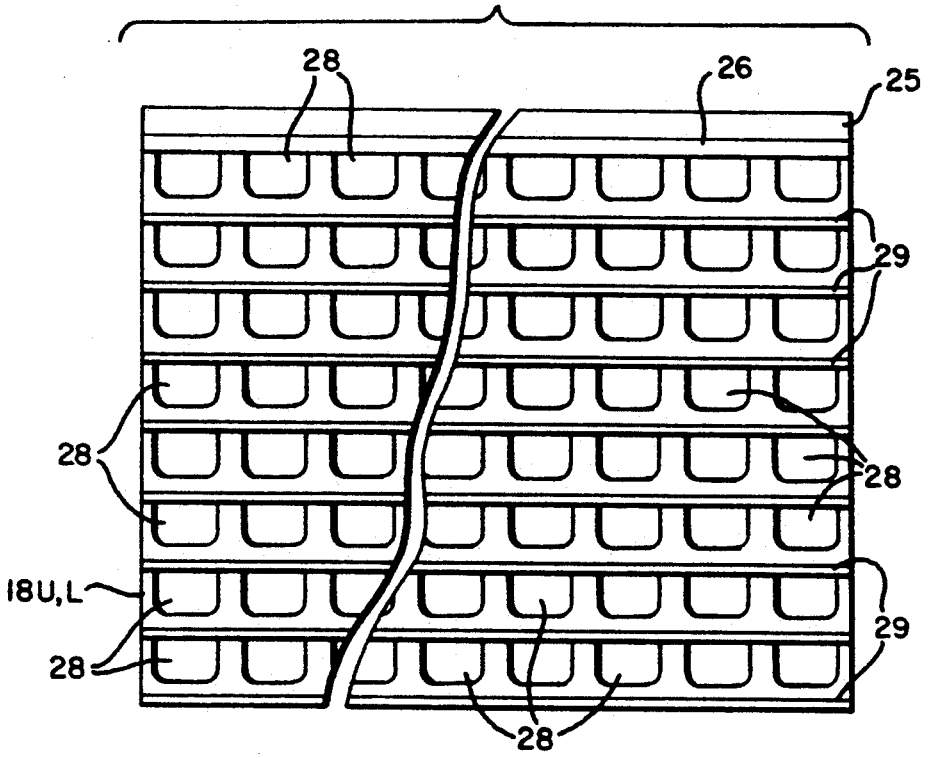
Figure 8:
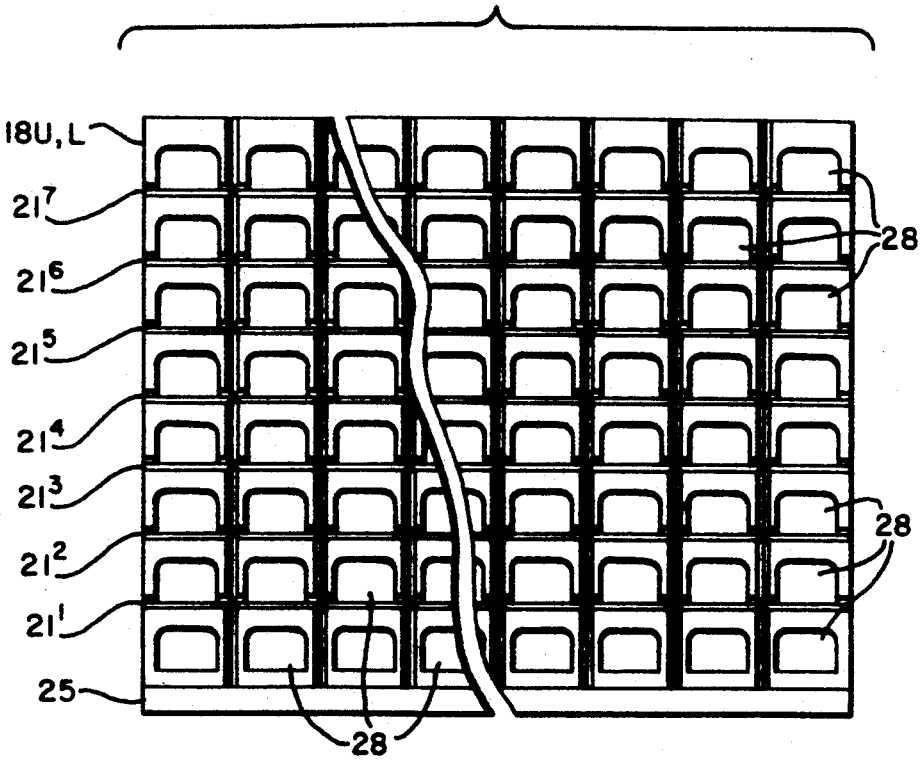
Figure 9:
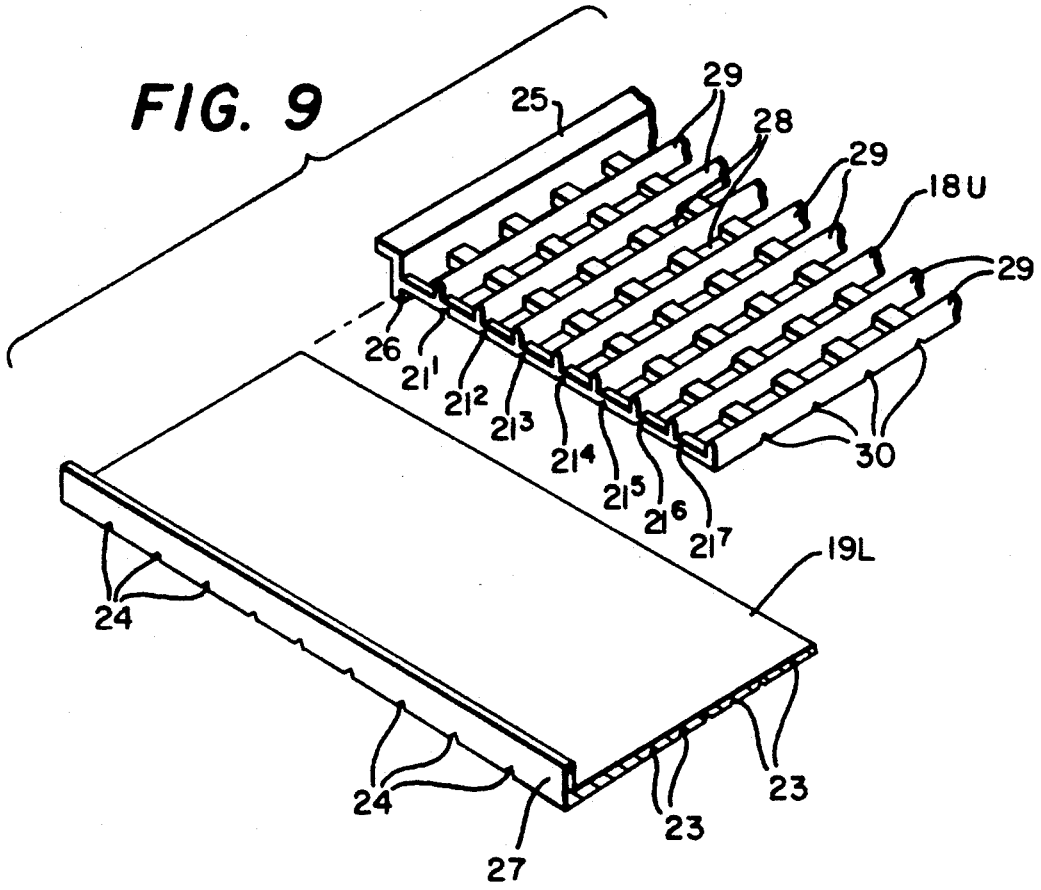

FIG. 1 represents a front elevation view of a microwave oven mounted in an in the wall opening with a facing trim kit with adjusted elements mounted in place around the front of the microwave;

FIG. 2, a side elevation view of the microwave oven mounted in place in a hole in the wall taken from line 2—2 of FIG. 1, with facing trim kit elements in place;

FIG. 3, a cut away and sectioned view showing, in elevation, detail of an upper facing trim element in place with two strips broken away (shown in phantom) and the upper end of a vertical strip;

FIG. 4, a cut away and sectioned view looking downward on a vertical strip element cross section and a bottom facing trim element end;

FIG. 5, a rear perspective view of a side facing trim element;

FIG. 6, a front perspective view of a side facing trim element;

FIG. 7, a front view of a facing trim element that is useable as an upper facing trim element or, when inverted as a lower facing trim element;

FIG. 8, a rear view of a facing trim element, inverted from FIG. 7, useable as a lower facing trim element in the inverted state shown with both horizontal and vertical strip break away notches shown; and FIG. 9, an exploded perspective of a horizontal facing trim element removed from interconnection with an end of a vertical facing trim element.

Referring to the drawings

A microwave oven 10 is shown in FIGS. 1 and 2 to be mounted in a rectangular opening 11 in wall 12 mounted by "U" shaped support rails 13 on the bottom 14 of opening 11 with the door opening and control end 15 of the oven 10 extending outward relative to the face 16 of wall 12. The "U" shaped support rails 13 are shown to be inverted on opening 11 bottom 14 and just inside laterally of support feet 17 although they could be outside thereof in supporting the oven 10 above the wall opening bottom 14. A front facing trim kit includes upper and lower trim air vent elements 18U and 18L, respectively, and opposite side upright trim elements 19L and 19R, respectively, providing front trim facing above and below and to opposite sides surrounding the front face of the microwave oven 10.

Referring also to FIGS. 3–9 the upper and lower vent facing elements 18U and 18L and the opposite side upright trim facing elements 19L and 19R are fastened in place by screws 20 extending, in the four corners of the facing trim kit, through the outer trim facing elements 18U and 18L, thereunder the opposite side upright trim elements 19L and 19R and into the wall 12. Thus, in a properly balanced trim facing assembly as related to the microwave oven 10 size and the opening 11 size strips of trim facing elements 18U, 18L, 19L and 19R may be broken away to properly fit the front facing trim kit to a specific installation. In FIG. 3 an upper trim facing air vent element 18U is shown, in phantom, to have a two section horizontal break away strip 18' broken away along a horizontal notch 21 with there being a plurality of such notches 21 ($21^1$, $21^2$, $21^3$, $21^4$, $21^5$, $21^6$, $21^7$). The lower trim facing air vent element 18L is the same as 18U just inverted with respect thereto so if a two section horizontal break away strip 18 is broken away from 18U then, generally, a two section horizontal break away strip is broken away from element 18L for it to be a balanced trim facing installation around the face 15 of a microwave 10. The upper and lower trim facing elements 18U and 18L also have vertical parallel notches 22 for endwise break away sections as required to properly fit a trim facing installation around the face 15 of a microwave 10.

The opposite side uright trim facing elements 19L and 19R are the same merely reversed one from the other and have vertically extended break away notches 23 and horizontally extended break away notches 24 for break away of end portions. This provides for length changes to match end positioning correctly underlying to upper and lower trim facing air vent elements 18U and 18L with the interrelation shown in greater detail in FIGS. 3 and 4. The upper and lower ends of opposite side upright facing trim elements 19L and 19R underlying the ends of upper and lower air vent facing elements 18U and 18L that have outer "L" shaped shoulders 25 with an inner projection 26 approximately the thickness of and enclosing the end edge of the elements 19L and 19R. The opposite side elements 19L and 19R are each provided with an outer shoulder 27 that encloses the opposite ends of elements 18U and 18L at all four corners of the facing trim kit installation around the front face of microwave oven 10. The elements 18U and 18L have vent openings 28 and multiple flanges 29 with each extending outwardly from each strip section of its element 18U and 18L.

With the kit structure provided sections 19L and 19R may have broken away strips and portions to match the broken away strips and end section reduced lengths with break away along vertical notches 30 of upper and lower elements 18U and 18L for proper matching.

Whereas this invention is herein illustrated and described with respect to a single embodiment thereof, it should be realized that various changes may be made without departing from the essential contributions to the are made by the teachings hereof.

I claim:

1. A facing kit for in the wall opening mounting of an appliance comprising: upper and lower elongate horizontal elements; opposite side elongate vertical elements; an appliance having a rectangular forward face, and an in the wall opening from a wall face being rectangular and having horizontal and vertical dimensions greater than the corresponding dimensions of the rectangular face of the appliance; said opposite side elongate vertical elements having inner edges abutting opposite sides of the rectangular forward face of the appliance and outer edges overlying side portions of said wall face adjacent said wall opening; and upper and lower elongate horizontal elements having inner edges abutting upper and lower edges of the rectangular forward face of the appliance and having outer edges overlying upper and lower portions of said wall face adjacent said wall opening and having opposite ends overlying opposite ends of said opposite side elongate vertical facing elements in a trim kit facing assembly around the front of an in the walls hole mounted appliance; wherein said upper and lower elongate horizontal elements are air vent facing elements with multiple vent openings; said upper and lower elongate horizontal elements include outer edges each with a inwardly extended projection approximating the thickness of said opposite side elongate vertical elements and in assembly enclosing opposite ends of said elongate vertical elements; said opposite side elongate vertical elements each have an outwardly extended projection at the outer edges thereof that in assembly enclose opposite ends of said upper and lower horizontal elements; and wherein said upper and lower elongate horizontal facing elements have notched break away strips both horizontally and vertically to provide adjusted width front trim facing above and below an appliance wall opening.

2. The facing claim kit of claim 1, wherein said opposite side elongate vertical trim facing elements have notched break away strip's both horizontally and vertically to enable proper fit in a facing trim assembly around the front of an in the wall mounted appliance.

3. The facing trim kit of claim 2, wherein the appliance is a microwave oven.

4. The facing trim kit of claim 2, wherein mounting means is provided extending through the four corners of an assembled facing trim kit where the opposite ends of said upper and lower elongate horizontal facing elements overly opposite ends of said opposite side elongate vertical facing elements and on into the wall.

5. The facing trim kit of claim 4, wherein said mounting means are screws.

6. The facing trim kit of claim 5, wherein said upper and lower elongate horizontal facing elements are each provided with a plurality of horizontal reinforcing ribs.

7. The facing trim kit of claim 6, wherein there is at least one of said horizontal reinforcing ribs per notched break away strip.

8. The facing trim kit of claim 7, wherein there is a row of vent openings in each of said notched break away strips.

* * * * *